US006019449A

United States Patent [19]

Bullock et al.

[11] Patent Number: 6,019,449

[45] **Date of Patent: *Feb. 1, 2000**

[54] APPARATUS CONTROLLED BY DATA FROM CONSUMABLE PARTS WITH INCORPORATED MEMORY DEVICES

[75] Inventors: Michael L Bullock; Winthrop D Childers, both of San Diego, Calif.

[73] Assignee: Hewlett-Packard Company, Palo Alto, Calif.

[ * ] Notice: This patent is subject to a terminal disclaimer.

[21] Appl. No.: 09/092,111

[22] Filed: Jun. 5, 1998

[51] Int. Cl.[7] ..... B41J 29/38

[52] U.S. Cl. ..... 347/14; 347/19; 347/50

[58] Field of Search ..... 347/7, 14, 17, 347/19, 20, 50

[56] References Cited

U.S. PATENT DOCUMENTS

| | | | |
|---|---|---|---|
| 4,551,000 | 11/1985 | Kanemitsu | 355/3 R |
| 4,748,453 | 5/1988 | Lin | 346/1.1 |
| 4,803,521 | 2/1989 | Honda | 355/14 R |
| 4,943,813 | 7/1990 | Palmer | 346/1.1 |
| 4,961,088 | 10/1990 | Gilliland | 355/206 |
| 5,021,828 | 6/1991 | Yamaguchi | 355/209 |
| 5,049,898 | 9/1991 | Arthur | 346/1.1 |
| 5,132,711 | 7/1992 | Shinada | 346/140 R |
| 5,138,344 | 8/1992 | Ujita | 346/140 R |
| 5,184,181 | 2/1993 | Kurando | 355/260 |
| 5,272,503 | 12/1993 | LeSueur | 355/206 |
| 5,365,312 | 11/1994 | Hillmann | 355/206 |
| 5,410,641 | 4/1995 | Wakabayashi | 395/112 |
| 5,506,611 | 4/1996 | Ujita | 347/86 |
| 5,587,728 | 12/1996 | Edgar | 347/19 |
| 5,610,635 | 3/1997 | Murray | 347/7 |
| 5,633,670 | 5/1997 | Kwak | 347/188 |
| 5,788,288 | 8/1998 | Cowger et al. | 400/703 |

FOREIGN PATENT DOCUMENTS

| | | | |
|---|---|---|---|
| 0720916A2 | 7/1996 | European Pat. Off. | B41J 2/175 |

*Primary Examiner*—Ren Yan
*Assistant Examiner*—Dave A. Ghatt

[57] ABSTRACT

A printing system includes a replaceable cartridge for housing a supply of consumable marking media. The cartridge includes a cartridge memory for recording printing system-related parameters, including marking media parameters. A replaceable printing device, such as an ink jet head, includes a printhead memory for recording printing device-related parameters. A processor is coupled to the cartridge memory, the printhead memory and is responsive to parameters read from both memories to derive printing system function control values that are dependent upon one or more marking media parameters from the cartridge memory and one or more parameters from the printhead memory. The processor is thus able (in the case of an ink jet printing system) to determine a current ink supply value from a cumulative usage value stored on the cartridge memory and a drop volume parameter stored on the printhead memory. Further, a drop volume parameter stored on the printhead memory can be adjusted to accommodate a media type sensed by a media sensor.

21 Claims, 5 Drawing Sheets

APPARATUS CONTROLLED BY DATA FROM CONSUMABLE PARTS WITH INCORPORATED MEMORY DEVICES

FIELD OF THE INVENTION

This invention relates to apparatus that employs replaceable, consumable parts and, more particularly, to consumable parts which include integral memory for storing usage, calibration and other data that is used by a controlling processor to operate the apparatus.

BACKGROUND OF THE INVENTION

Substantially, all present-day copiers, printers, plotters, etc., include a controlling microprocessor which requires input calibration data to assure high quality production of documents. Since most such apparatus allows user-replacement of consumable items, various techniques have been developed to enable entry of usage, calibration and other data.

In regards to ink jet printers, it has been proposed that print heads incorporate a parameter memory for storage of operating parameters such as: drop generator driver frequency, ink pressure and drop charging values (see "Storage of Operating Parameters in Memory Integral with Print Head", Lonis, Xerox Disclosure Journal, Volume 8, No. 6, November/December 1983, page 503). U.S. Pat. No. 5,138,344 to Ujita, entitled "Ink Jet Apparatus and Ink Jet Cartridge Therefor", indicates that an ink-containing replaceable cartridge can be provided with an integral information device (i.e., a resistor element, magnetic medium, bar code, integrated circuit or ROM), for storage of information relating to control parameters for the ink jet printer.

U.S. Pat. No. 5,365,312 to Hillmann et al., entitled "Arrangement for Printer Equipment Monitoring Reservoirs that Contain Printing Medium", describes the use of memory devices integral with the ink reservoirs which store ink consumption data (for use by a coupled ink jet printer). European patent EP 0 720 916, entitled "Ink Supply Identification System for a Printer" describes the use of an ink supply having an integral EEPROM which is utilized to store data regarding the identity of the ink supply and its fill level.

The prior art further teaches the use of consumable parts with integral memory for use in electrophotographic printers. In U.S. Pat. No. 5,021,828 to Yamaguchi et al., entitled "Copying Apparatus having a Consumable Part", a toner cartridge is disclosed which includes a memory for storing data regarding to the state of consumption of toner in the cartridge. U.S. Pat. No. 4,961,088 to Gilliland et al.; U.S. Pat. No. 4,803,521 to Honda; U.S. Pat. No. 5,184,181 to Kurando et al.; and U.S. Pat. No. 5,272,503 to LeSueur et al. all describe various replaceable toner cartridges for use in electrophotographic printers. Each cartridge incorporates a memory device for storing parameter data regarding the cartridge.

Ink jet and laser printers have, in recent years, become more sophisticated in their operational and control functionalities. For instance, many such printers exhibit resolutions at levels of 600 dots per inch (dpi), double the previous printer generation resolution of 300 dpi. At such higher resolutions, misadjustments which were not visible at lower resolution levels become highly visible. Further, such printers are now being applied to generation of grey-scale images on media, requiring precise density and tonal control of the deposited ink/toner.

Thus, while it has been known that changes in functionality of various elements of a printer interact to affect print quality, many of those interactions could be ignored in the lower resolution printers. However, with performance improvements of new printer designs, such interactions must now be taken into account and compensated to assure high quality print documents.

Accordingly, it is an object of this invention to provide a print apparatus with an improved capability for adjustment of printer control functions.

It is another object of this invention to provide an improved printer control system which is able to update control parameters that are dependent upon current printer performance parameters contained on plural consumable parts.

It is yet another object of this invention to provide an improved ink jet printer which incorporates real time print control functions that are responsive to parameters read from plural consumable parts.

SUMMARY OF THE INVENTION

A printer includes a replaceable cartridge for housing a supply of consumable marking media. The cartridge includes a cartridge memory for recording printer-related parameters, including marking media parameters. A replaceable printing device, such as an ink jet head, includes a printhead memory for recording printing device-related parameters. A processor is coupled to the cartridge memory, the printhead memory and is responsive to parameters read from both memories to derive printer function control values that are dependent upon one or more marking media parameters from the cartridge memory and one or more parameters from the printhead memory. The processor is thus able (in the case of an ink jet printer) to determine a current ink supply value from a cumulative usage value stored on the cartridge memory and a drop volume parameter stored on the printhead memory. Further, a drop volume parameter stored on the printhead memory can be adjusted to accommodate a media type sensed by a media sensor.

DETAILED DESCRIPTION OF THE INVENTION

Figure 1A:
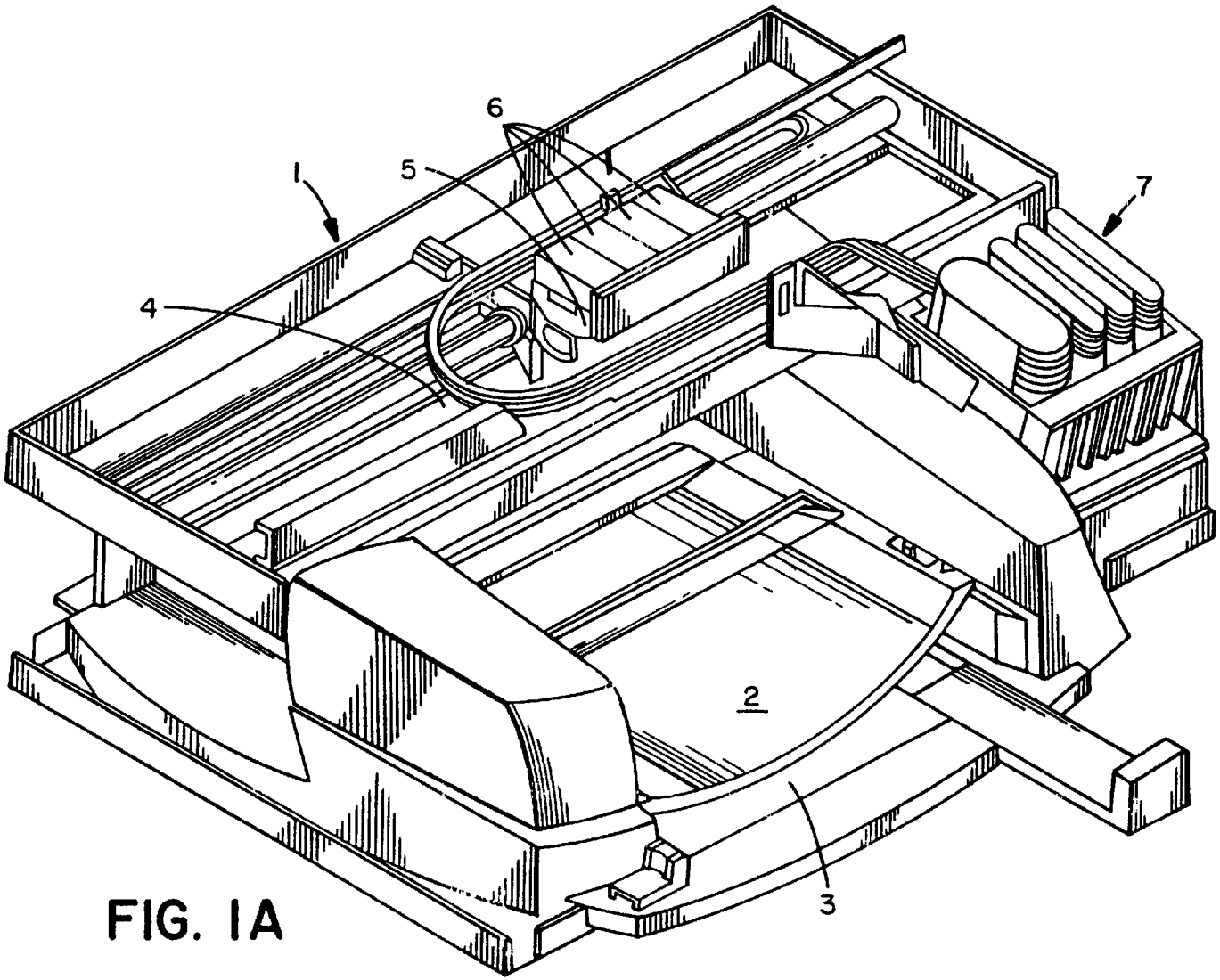
FIG. 1*a* is a perspective view of an ink jet printer (with cover removed), which incorporates the invention.

FIG. 1*a* illustrates a perspective view of an ink jet printer 1 incorporating the invention. A tray 2 holds a supply of input paper or other print media. When a printing operation is initiated, a sheet of paper is fed into printer 1 and is then brought around in a U direction towards an output tray 3. The sheet is stopped in a print zone 4 and a scanning carriage 5, containing plural, removable color printheads 6, is scanned across the sheet for printing a swath of ink thereon. The process repeats until the entire sheet has been printed, at which point, it is ejected onto output tray 3.

Printheads 6 are, respectively, fluidically coupled to four removable ink cartridges 7 holding Cyan, Magenta, Yellow and Black inks. Since black ink tends to be depleted most rapidly, the black ink cartridge has a larger capacity than the other cartridges. As will be understood from the description which follows, each printhead and ink cartridge is provided with an integral memory device which stores data that is used by printer 1 to control its printing operations.

Figure 1B:
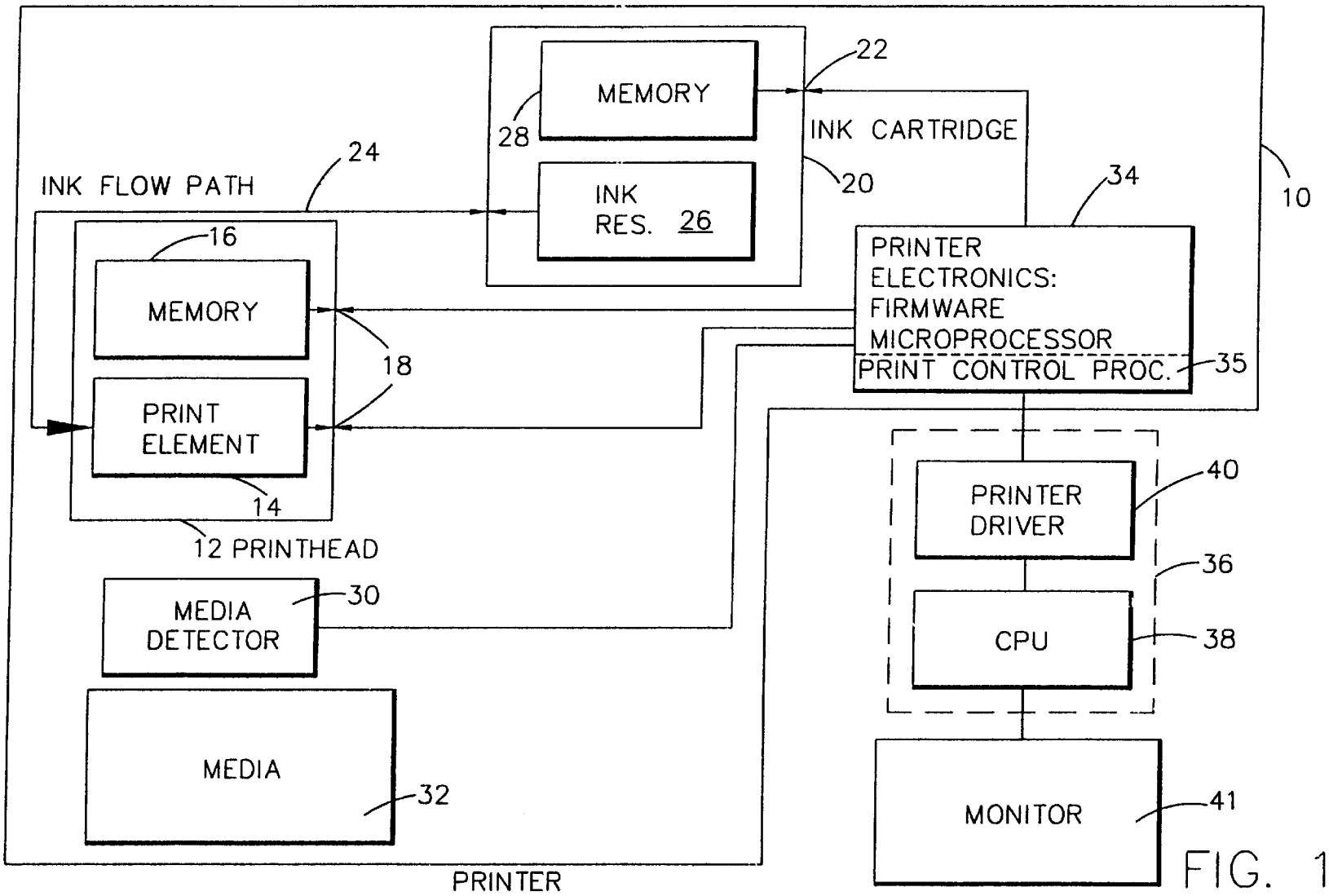
FIG. 1*b* is a block diagram of components of the ink jet printer of FIG. 1*a*.

FIG. 1*b* illustrates a block diagram of elements of the ink jet printer of FIG. 1*a*. Ink jet printer 1 includes a pluggable printhead 12 which includes a print element 14 and an integrally mounted printhead memory 16. Printhead 12 is pluggably removable from printer 1 via interconnects 18. An ink cartridge 20 is also pluggably removable from printer 1 via electrical interconnect 22 and fluidic interconnect 24. Ink cartridge 20 includes an ink reservoir 26 and an integral cartridge memory 28. The contents of memories 16 and 28 will be considered in detail below and, as will be understood, are instrumental in enabling real time control of ink jet printer 1 to produce high quality printed media.

A media detector 30 is positioned to scan an incoming media sheet 32 and determine from characteristics thereof, the specific type of media sheet which is being presented to printhead 12 for printing. Media sheet 32 may carry indicia that is only visible to media detector 30 (e.g., via an infra-red scan) or other indicia indicative of the media type.

Ink cartridge 20, printhead 12 and media detector 30 are interconnected to a microprocessor 34 which includes both electronics and firmware for the control of the various printer sub-assemblies. A print control procedure 35, which may be incorporated in the printer driver, causes the reading of data from cartridge memory 28 and printhead memory 16 and adjusts printer control parameters in accordance with parameter re-calculations based upon the data accessed from both memories.

A host processor 36 is connected to microprocessor 34 and includes a central processing unit (CPU) 38 and a software printer driver 40. A monitor 41 is connected to host processor 36 and is used to display various messages that are indicative of the state of ink jet printer 1.

Figure 3:
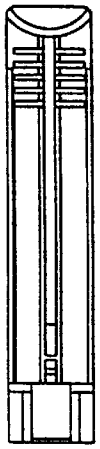
FIG. 3 is a side view of the ink cartridge of FIG. 2.
Figure 2:
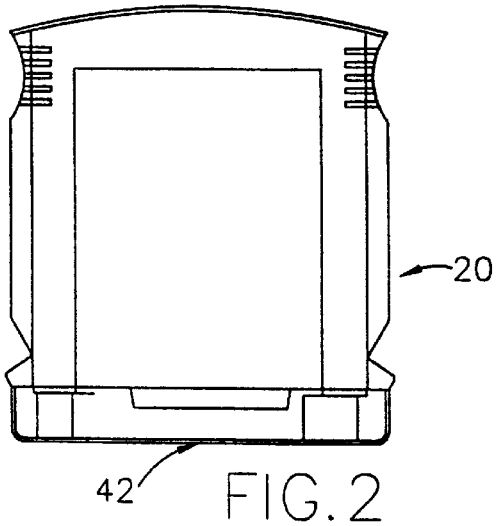
FIG. 2 is a frontal view of an ink-containing cartridge usable in the ink jet printer shown in FIG. 1.
Figure 4:
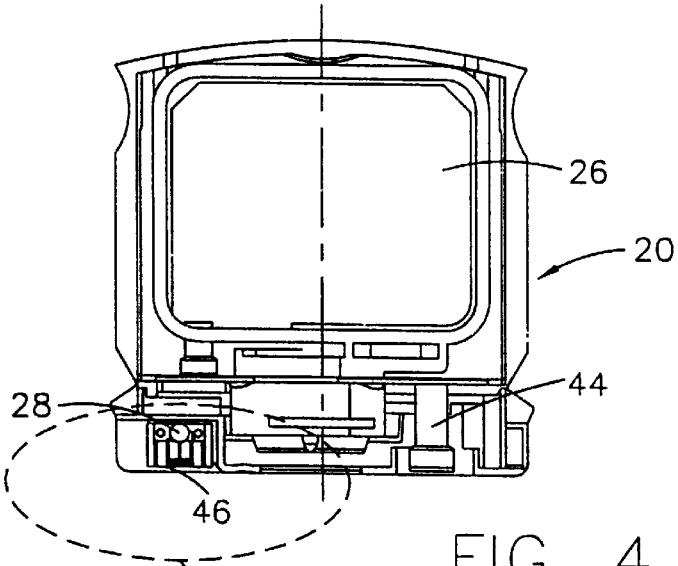
FIG. 4 is a schematic sectional view of the ink cartridge of a FIG. 2.

FIG. 2 illustrates a frontal view of ink cartridge 20 and FIG. 3, a side view thereof. Ink cartridge 20 is pluggable into a receptacle (not shown) in ink jet printer 1 and includes both a fluidic interconnection and an electrical interconnection, both of which are accessible through bottom surface 42. FIG. 4 shows a section of ink cartridge 20 and illustrates the positioning of ink reservoir 26, a fluidic connector 44 and an electrical connector 46. Electrical connector 46 enables interconnection to a cartridge memory chip 28.

Figure 4A:
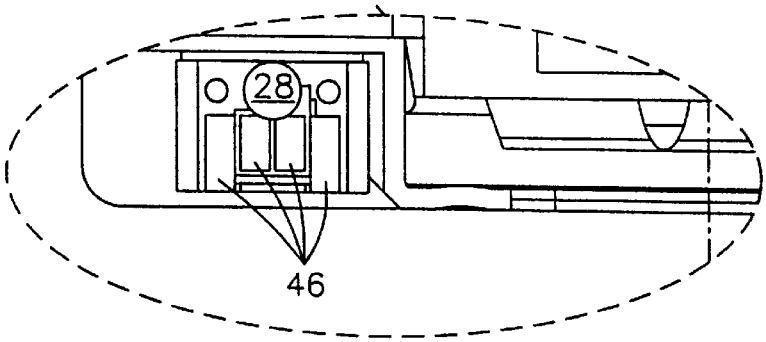
FIG. 4*a* is an expanded view of FIG. 4, showing details of a cartridge memory installed on the ink cartridge.

An expanded view of connector 46 and memory chip 28 are shown in FIG. 4*a*, with connector 46 making contact to a mating connector in the receptacle within ink jet printer 1 when ink jet cartridge 20 is pluggably inserted thereinto.

Figure 5:
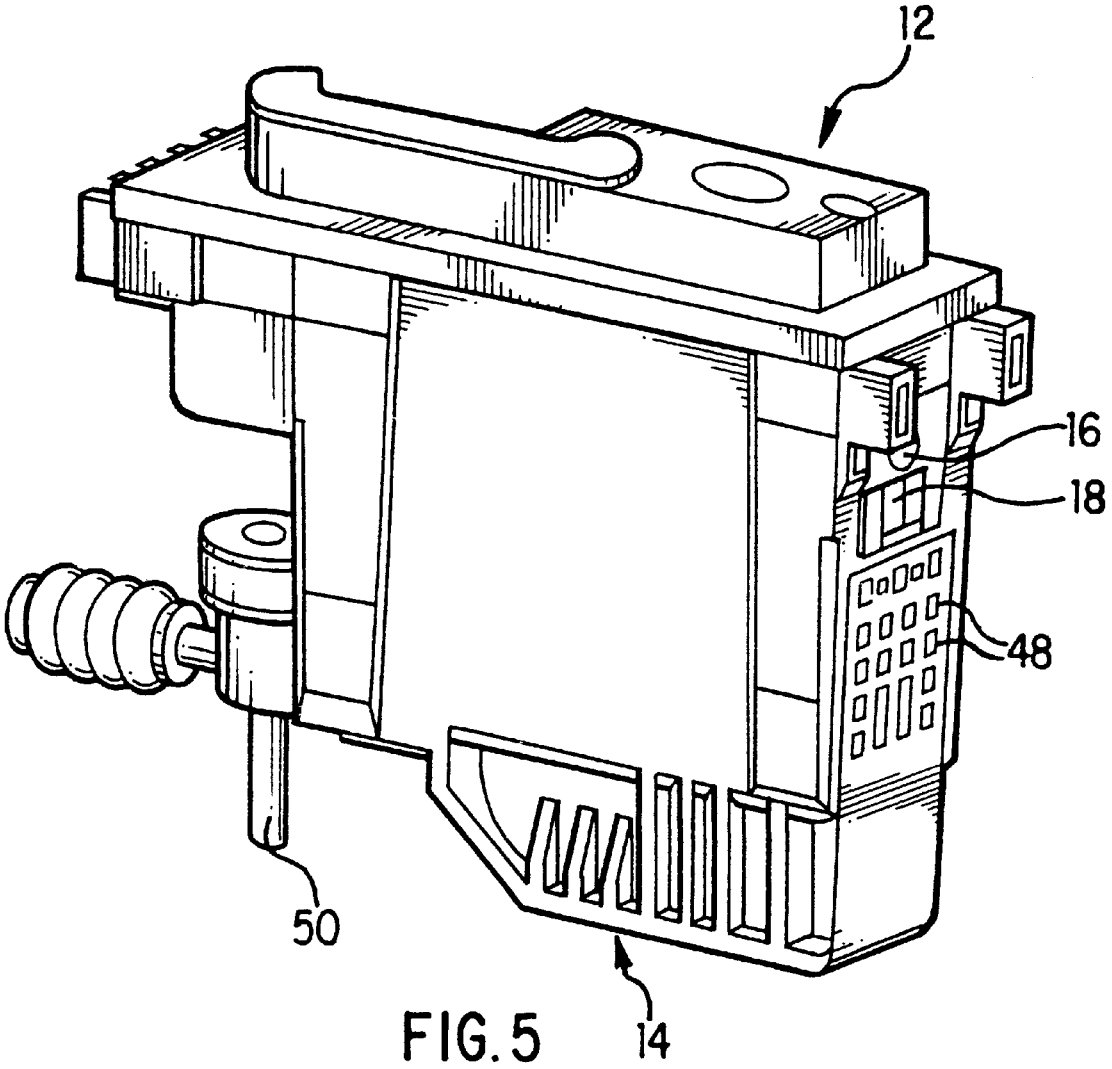
FIG. 5 is a perspective view of an ink jet printhead employed with the invention hereof.

FIG. 5 is a perspective view of printhead 12 and illustrates the placement of printhead memory 16 thereon. A plurality of contacts 48 enable pluggable interconnection to printhead memory 16 as well as various electrical elements within printhead 12. Printhead 12 is a known, thermally-actuated ink jet printhead, with a print element (including an orifice plate) positioned at surface 14. Behind each orifice is an ink chamber with a heater resistor. A thermal sense resistor is positioned on the printhead and detects the temperature of the semiconductor substrate on which the heater resistors are positioned. A fluidic interconnect 50 connects ink cartridge 12, via ink flow path 24 (see FIG. 1), to ink reservoir 26 in ink cartridge 20. When printhead 12 is plugged into a receptacle (not shown) within ink jet printer 1, contacts 48 make electrical connection to a mating connector in the printer and fluidic interconnect 50 automatically mates to ink flow path 24 to enable a flow of ink thereto.

As indicated above, cartridge memory 28 and printhead memory 16 enable microprocessor 34 to calculate control values which enable printer 1 to maintain high quality print media output. Data from media detector 30 is also employed for certain aspects of print media quality enhancement. To accomplish control of printer parameters, each of memories 16 and 28 includes both factory-written data and printer-recorded data. While not complete, the following is a list of data values stored within the aforesaid memories:

Cartridge memory 16

- Factory-written data:
  - Product tag
  - Supply size
  - Color map coefficients
  - Ink colorimetry
  - Color code
  - Dry time coefficient
  - Printer driver revision number
  - Printer driver revision parameters
  - Re-order part number
  - Manufacture day
  - Manufacture year
  - Freshness date
  - Ink shelf life
  - Serial number
  - Print mode coefficients
  - Outgas rate data for ink
- Printer written data:
  - Coarse count
  - Fine count
  - First insertion date
  - Last usage date
  - In-use time Printhead memory 16

- Factory recorded data:
  - Product tag
  - Drop volume measurement
  - Drop volume coefficients
  - Manufacture year
  - Manufacture day
  - Freshness date
  - Temperature sense resistor calibration data
  - Printhead alignment coefficients
  - Firing energy parameters
  - Print mode coefficients
  - Re-order part number
  - Driver version number
- Printer-recorded data:
  - Number of drops fired
  - First insertion date
  - Last usage date
  - In-use time
  - Number of pages printed.

As will be hereafter understood, print control procedure 35 makes use of the above-indicated parameters stored in memories 16 and 28 to control the operation and print quality of media output from ink jet printer 1. In a number of instances, data from both memories 16 and 28 are utilized to arrive at an improved control parameter. Further, the ability to periodically replace memories 16 and 28, as their host carriers (e.g., printhead 12 or ink cartridge 20) are replaced, enables the manufacturer to provide updated parameters, on a continuing basis, to customers who already have installed printers.

Figure 6:
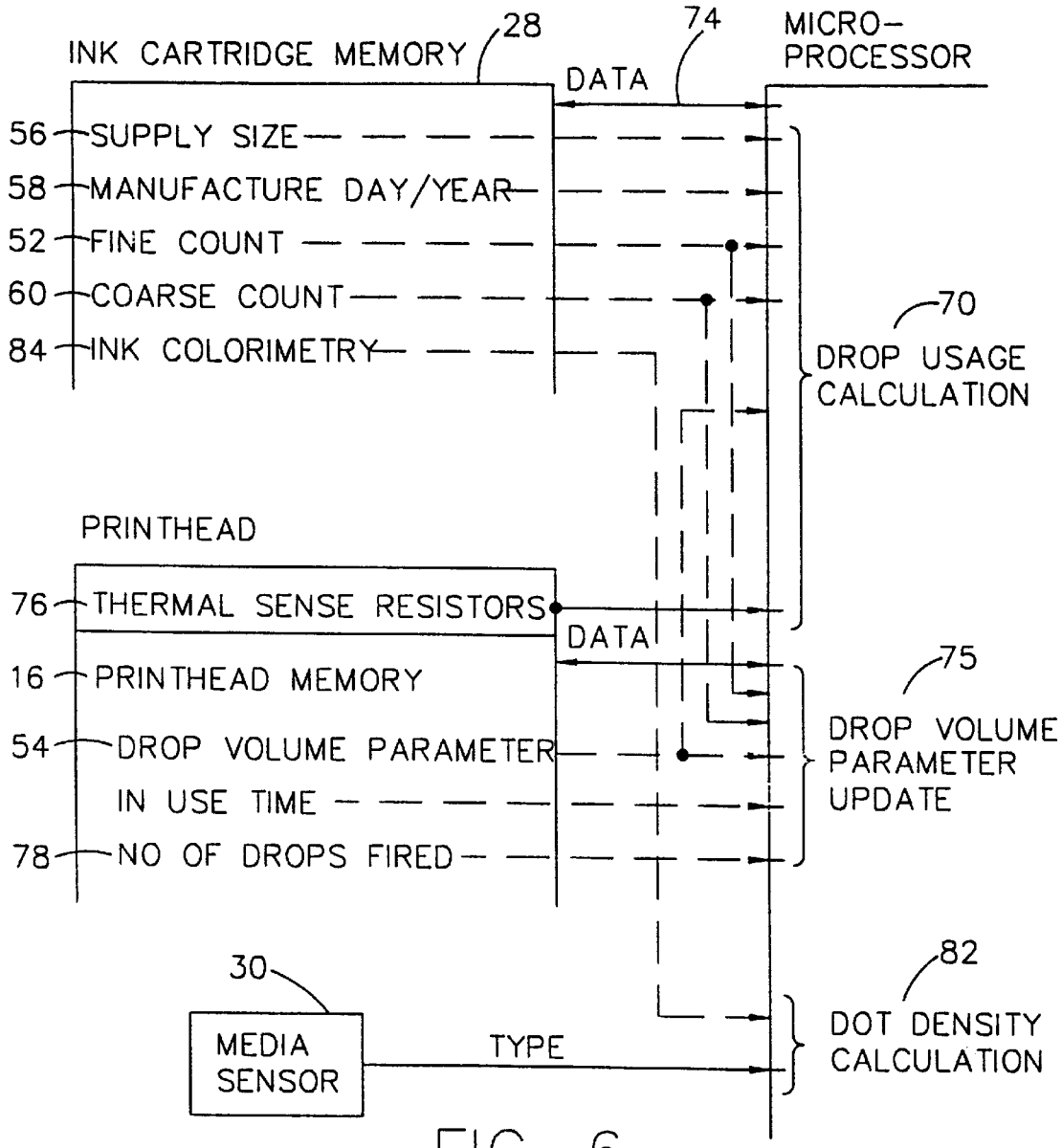
FIG. 6 is a schematic diagram indicating certain data stored in the cartridge memory contained on the ink cartridge of FIG. 2 and the printhead memory stored on the printhead of FIG. 5, and illustrating the usage of such data in deciding printer control values.

Turning to FIG. 6, subprocedures incorporated into print control procedure 35 will be described which utilize data from both printhead memory 16 and cartridge memory 28 and, in some cases, an input from media sensor 30. Before describing the subprocedures it is worthwhile to consider certain details of the data stored in printhead memory 16 and cartridge memory 28.

A fine count value 52 stored in cartridge memory 28 is an 8-bit (for example) re-writable value, with each bit corresponding to 1/256 of 12.5% of the total supply volume of ink cartridge 20. To calculate when to "flip" a fine count bit value, print control procedure 35 reads both a drop volume parameter 54 (encoded on printhead memory 16) and an ink supply volume value 56 (encoded on cartridge memory 28). Print control procedure 35 then calculates how many drops are required too cause one fine count bit flip (i.e., an amount equal to 1/256 of 12.5% of the total supply volume). Then, by counting input signals fed to the heater resistors (as indicative of the cumulative number of emitted ink drops), print control procedure 35 knows when to increment the value in fine count value 52.

When ink cartridge 20 is first inserted, print control procedure 35 reads the manufacture day/year data 58 to determine the age of ink cartridge 20. Thereafter, the value of fine count entry 52 is adjusted to take into account evaporation assumptions.

A coarse count value 60 in cartridge memory 28 is incremented each time 12.5% of the ink in ink cartridge 20 is consumed. Coarse count value 60 is incremented each time fine count value 52 "rolls over". As will be hereafter understood, fine count value 52 and coarse count value 60 are both utilized to determine an amount of remaining ink in ink cartridge 20.

As indicated in FIG. 6, a drop usage calculation subprocedure 70 employs a number of values stored on both cartridge memory 28 and printhead memory 16 to calculate an amount of ink remaining in ink cartridge 20. Thus, drop usage calculation subprocedure 70 reads drop volume parameter 54 from printhead memory 16 and ink supply size parameter 56 from ink cartridge memory 28. Further, inputs from thermal sense resistors 76 (associated with print element 14 in FIG. 1) are also input to drop usage calculation subprocedure 70. From the drop volume parameter and thermal sense resistor inputs, the total volume of drops emitted are calculated and, using supply size parameter 56, subprocedure 70 calculates the remaining amount of ink available in cartridge 28. Upon arriving at such a calculated value, fine count value 52 is incremented to reflect the current ink usage state and, if a "roll-over" of the count is sensed, coarse count value 60 is also incremented. These calculations occur as printing takes place, with fine count value 52 and coarse count value 60 being incremented to reflect the volume of ink ejected by printhead 12. As drop usage calculation subprocedure 70 arrives at new values for fine count value 52 and coarse count value 60, such values are accordingly rewritten into cartridge memory 28 via data line 74.

Because ink supply cartridge sizes will vary, both drop volume parameter 54 and initial supply size parameter 56 are used in the calculation.

A drop volume parameter update subprocedure 75 is periodically run to account for changes in drop volume which occur as printhead 12 ages. Drop volume parameter update subprocedure 74 initially accesses drop volume parameter 54 from printhead memory 16. It then employs cumulative usage data to estimate the state of the printhead. That cumulative usage value is calculated by use of fine count value 52, coarse count value 60 from a current ink cartridge 20 and previous fine and coarse count values from now-replaced ink cartridges. That data is accumulated on printhead memory 16 in the form of a cumulative "number of drops fired" value 76. An algorithm for re-calculation of drop volume uses the following expressions:

$$Vcalc=Vmeas+\Delta Vtrans+\Delta Vtime+\Delta V\#drops+\Delta V(T)+\Delta V(f)$$

$$\Delta Vtime=k1t+k2t^2+\ldots$$

$$\Delta V\#drops=c1N+c2N^2+\ldots$$

$$\Delta V(T)=b1T+b2T^2+\ldots$$

$$\Delta V(f)=d1f+d2f^2+\ldots$$

where: Vcalc=calculated drop volume

Vmeas=drop volume measured in the factory.

ΔVtrans=transient drop volume change (from surface wetting or burn-in).

ΔVtime =effect of time (long term) on drop volume k1, k2, . . . =constants t=time elapsed since printhead was manufactured Note: the constants are characterized and encoded at the printhead factory; the time t is calculated by the printer by comparing the computer clock to the date code on the printhead.

ΔV#drops=effect of firing on drop volume (long term—build up on resistor)

c1,c2, . . . =constants

N=number of drops fired since printhead was manufactured

ΔV(T)=effect of temperature b1, b2, . . . =constants

T=printhead temperature. It is calculated from a formula that relates the temperature to the TSR (thermal sense resistor) output; the TSR is monitored by the system to infer head temperature.

ΔV(f)=Effect of firing frequency d1, d2, . . . =constants

Note: Vtrans, k1, k2, d1, d2, c1, c2, b1, b2 are recorded at the factory; t is recorded on the printhead memory chip by the printer (by comparing a computer clock to the date code recorded on the ink cartridge memory); and N is recorded on the cartridge memory chip by the printer.

As the usage of printhead 12 increases, drop volume parameter update subprocedure 74 alters the drop volume parameter to track changes in the drop volume (e.g., as a result of ink build-up in the ink chambers and other factors). That drop volume parameter may then be rewritten to printhead memory 16 via data line 80.

Figure 7:
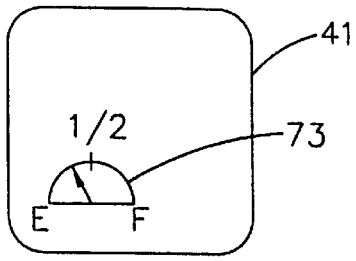
FIG. 7 is a schematic of a display used in the system of FIG. 1, illustrating a "gas gauge" to indicate the ink supply level in the ink cartridge of FIG. 2.

In order to provide the user with an indication of remaining ink in ink cartridge 20, drop usage calculations subprocedure 70 provides an output value to host processor 36 which implements a display procedure to cause monitor 40 to exhibit a "gas gauge", which is shown on monitor 41 in FIG. 7. Monitor 41 includes a gas gauge representation 73 in the lower left corner thereof. As the remaining ink quantity in ink cartridge 20 reduces, the indication of gas gauge 73 is altered accordingly.

A further subprocedure is periodically run each time a new media type is sensed by media sensor 30. As indicated above, media sensor 30 is enabled to detect a specific media type by invisible or visible indicia imprinted on the media and to provide a media type value to a dot density calculation subprocedure 82. In response, dot density calculation subprocedure 82 reads drop volume parameter 54 from printhead memory 16 and ink colorimetry parameter 84 from ink cartridge memory 28. Utilizing those two parameters, dot density calculation subprocedure 82 then calculates adjustments required for changes in dot density to achieve a correct hue and intensity on the sensed media type.

It should be understood that the foregoing description is only illustrative of the invention. Various alternatives and modifications can be devised by those skilled in the art without departing from the invention. While the above invention has been described in the context of an ink jet printer, those skilled in the art will realize that it is equally applicable to other printer/copier arrangements which employ replaceable units and wherein control procedures are dependent upon parameters read from multiple such replaceable units. Accordingly, the present invention is intended to embrace all such alternatives, modifications and variances which fall within the scope of the appended claims.

It is claimed:

1. An ink jet printing system, comprising:

printing system control electronics for controlling the operation of the printing system:

an ink jet printhead adapted to be installed in the printing system:

a first memory device mounted on the ink jet printhead and containing printhead-related data;

a first electrical interconnect on the printhead coupling the first memory device to the printing system control electronics when the printhead is installed in the printing system;

an ink cartridge adapted to be installed into the printing system and containing a supply of ink;

a second memory device mounted on the ink cartridge and containing ink-related data;

a second electrical interconnect on the ink cartridge coupling the second memory device to the printing system control electronics when the ink cartridge is installed in the printing system;

wherein the first memory device and the second memory device provide information to the printing system control electronics in order to carry out a printing operation.

2. The printing system of claim 1, wherein the printing system control electronics receive information which includes a first parameter accessed from the first memory device through the first electrical interconnect on the printhead and a second parameter accessed from the second memory device through the second electrical interconnect on the ink cartridge and derive a printer function control value in response.

3. The printing system of claim 2, wherein the first parameter is indicative of an ink drop volume of the ink jet printhead and the second parameter is indicative of an initial volume of the ink in the ink cartridge.

4. The ink jet printing system of claim 1 wherein the first memory device contains factory-written data.

5. The ink jet printing system of claim 4 wherein the first memory device contains printer-recorded data.

6. The ink jet printing system of claim 1 wherein the second memory device contains factory-written data.

7. The ink jet printing system of claim 6 wherein the second memory device contains printer-recorded data.

8. A printhead for an ink jet printing system including printing system control electronics that control operation of the printing system, the printhead comprising:

a housing adapted to be removably installed in the printing system;

a print element mounted to the housing for selectively depositing ink drops on the print media; and a memory device having a direct electrical interconnecting contact coupling the memory device to the printing system control electronics when the housing is installed in the printing system;

wherein the printing system control electronics derive a printing function control value that is dependent upon at least a print element parameter accessed through the direct electrical interconnecting contact from the memory device as well as a different parameter accessed from another memory device on an ink supply removably installed in the printing system.

9. A printhead for an ink jet printing system including printing system control electronics that control operation of the printing system, the printhead comprising:

a housing adapted to be releasable installed in the printing system;

a print element mounted to the housing for selectively depositing ink on print media;

a memory device mounted on the housing; and an electrical interconnect on the housing coupling the memory device to the printing system control electronics when the housing is installed in the printing system wherein the printing system control electronics derive a printing function control value that enables the printing system control electronics to perform a dot density calculation which is dependent upon at least a print element parameter stored in the memory device and a media parameter that is indicative of print media properties in order to carry out a printing operation.

10. An ink jet printhead for installation into an in jet printing system that includes printing system control electronics for controlling operation of the printing system, the printhead comprising:

a print element for ejecting ink drops onto media; and a first memory device mounted on the printhead and having a direct electrical interconnecting contact coupling the memory device to the printing system control electronics when the printhead is installed in the printing system;

wherein information is provided by the first memory device to the printing system control electronics as a basis for deriving a printing system function control value that is also dependent upon additional information associated with an ink supply or print media in order to carry out a printing operation.

11. The ink jet printhead of claim 10, wherein the additional information includes a parameter that is indicative of an amount of ink initially present in an ink supply for providing ink to the printhead.

12. The ink jet printhead of claim 11, wherein the printing system control value is a number of ink drops that are fired per count of an ink volume counting means.

13. An ink jet printhead for installation into an ink jet printing system that includes printing system control electronics for controlling operation of the printing system, the printhead comprising:

a print element for ejecting ink drops onto media;

a first memory device mounted on the printhead; and a first electrical interconnect on the printhead coupling the first memory device to the printing system control electronics when the printhead is installed in the printing system;

wherein in order to carry out a printing operation the printing system control electronics derives a printing system function value that is dependent upon at least the information provided by the first memory device including a volume parameter indicative of a drop volume characteristic of the print element and additional information associated with an ink supply or print media; and wherein the printer function control value is utilized to adjust a dot density produced by the printing system.

14. An ink cartridge for an ink jet printing system including printing system control electronics for controlling the operation of the printing system and including an ink jet printhead having a first memory device coupled through a first electrical interconnect to the printing system control electronics when the printhead is installed into the printing system, the ink cartridge comprising:

a housing adapted to be releasably installed onto the printing system and configured to provide ink to the printhead when the housing is releasable installed onto the printing system;

a second memory device mounted to the cartridge housing; and a second electrical interconnect on the cartridge housing for coupling the second memory device to the printing system control electronics when the cartridge housing is releasable installed into the printing system;

wherein in order to carry out a printing operation information is provided by the first memory device and the second memory device to the printing system control electronics including information at least indicative of an amount of ink remaining within the ink cartridge and wherein the printing system updates this information to reflect ink utilized by the printhead; and wherein the remaining volume information includes a plurality of coarse bits, writing to each coarse bit corresponds to utilizing a predetermined fraction of the initial quantity of ink.

15. The ink cartridge of claim 14, wherein the remaining volume information includes a plurality of fine bits, the entire range of the fine bits corresponds to one of the coarse bits.

16. The ink cartridge of claim 15, wherein each coarse bit corresponds to 12.5% of the initial quantity of ink.

17. The ink cartridge of claim 15, wherein the first memory element provides a drop volume parameter indicative of a drop volume of the printhead.

18. The ink cartridge of claim 17, wherein the second memory element provides an initial volume parameter indicative of an amount of ink initially associated with the second replaceable component, the printing system utilizes the drop volume parameter and the initial volume parameter to derive a parameter indicative of a number of ink drops corresponding to a fine count bit flip.

19. An ink cartridge for an ink jet printing system including a printing system control electronics for controlling the operation of the printing system and including an ink jet printhead having a first memory device coupled through a first electrical interconnect to the printing system control electronics when the printhead is installed into the print system, the ink cartridge comprising:

a housing adapted to be releasably installed onto the printing system and configured to provide ink to the printhead when the housing is releasably installed onto the printing system; and a second memory device mounted to the cartridge housing; and a second electrical interconnect on the cartridge housing coupling the second memory device to the printing system control electronics when the cartridge housing is releasably installed into the printing system;

wherein information is provided by the first memory device and the second memory device to the printing system control electronics in order to carry out a printing operation; and wherein the first memory element provides a drop volume parameter indicative of a drop volume of the printhead, and the second memory element provides an initial volume parameter indicative of an amount of ink initially associated with the second replaceable component, the printing system utilizes the drop volume parameter and the initial volume parameter to derive a parameter indicative of a number of ink drops corresponding to a fine count bit flip.

20. An ink supply component configured for connection to a printing system including printing system control electronics for controlling operation of the printing system and a printhead having a first memory device thereon coupled through a first electrical interconnect to the printing system control electronics when the printhead is installed into the printing system, the ink supply comprising:

a supply of ink:

an ink reservoir holding the ink and fluidically coupled to a discharge port, the discharge port configured to connect the ink reservoir to the printing system when the ink supply component is connected to the printing system;

a second memory device coupled through a second electrical interconnect that couples the memory device to the printing system control electronics when the ink supply component is connected to the printing system;

wherein information is provided by the first memory device and the second memory device through the first electrical interconnect and the second electrical interconnect, respectively, to the printing system control electronics in order to derive a printer value control function to carry out a printing operation.

21. An ink supply configured for connection to a printing system including printing system control electronics for controlling operation of the printing system and a printhead having a first memory device thereon that couples to the printing system control electronics when the printhead is installed into the printing system, the ink supply comprising:

an ink reservoir fluidically coupled to a discharge port, the discharge port configured to connect the ink reservoir to the printing system when the ink supply is connected to the printing system;

a second memory device coupled through an electrical interconnect to the printing system control electronics when the ink supply is connected to the printing system;

wherein information is provided by the first memory device and the second memory device to the printing system control electronics in order to carry out a printing operation; and wherein the first memory device provides information to the printing system indicative of a drop volume characteristic of the ink jet printhead, the second memory device provides information to the printing system control electronics indicative of an initial volume of ink associated with the ink supply, such that the printing system used the information indicative of a drop volume characteristic and information indicative of an initial volume of ink associated with the ink supply to calculate a number of drops associated with a fine count bit flip.

* * * * *